US008109453B2

(12) United States Patent
Tschantz

(10) Patent No.: US 8,109,453 B2
(45) Date of Patent: Feb. 7, 2012

(54) METHOD OF USING A MATERIALS CRUSHER AND BOTTOM DUMP FEEDER

(75) Inventor: Richard W. Tschantz, Louisville, OH (US)

(73) Assignee: Imperial Technologies, Inc., Canton, OH (US)

( * ) Notice: Subject to any disclaimer, the term of this patent is extended or adjusted under 35 U.S.C. 154(b) by 0 days.

(21) Appl. No.: 13/012,961

(22) Filed: Jan. 25, 2011

(65) Prior Publication Data

US 2011/0114767 A1 May 19, 2011

Related U.S. Application Data

(62) Division of application No. 12/351,214, filed on Jan. 9, 2009, now Pat. No. 7,886,997.

(60) Provisional application No. 61/010,607, filed on Jan. 10, 2008.

(51) Int. Cl.
*B02C 23/18* (2006.01)

(52) U.S. Cl. ..... 241/23; 241/65; 241/101.2; 241/200; 241/DIG. 37

(58) Field of Classification Search ..... 241/200, 241/DIG. 37, 101.2, 65
See application file for complete search history.

(56) References Cited

U.S. PATENT DOCUMENTS

| | | | |
|---|---|---|---|
| 3,101,757 | A | 8/1963 | Hanson |
| 3,527,414 | A | 9/1970 | Schorsch |
| 3,718,284 | A | 2/1973 | Richardson |
| 5,368,240 | A | 11/1994 | Bonnet |
| 5,842,650 | A | 12/1998 | Hofmann |
| 6,013,685 | A | 1/2000 | Pauls |

FOREIGN PATENT DOCUMENTS

WO 2005/023025 3/2005

OTHER PUBLICATIONS

Bottom Ash System Maintenance Guide, EPRI, Dec. 6, 2006; (retrieved from the internet) Retrieved on Feb. 12, 2009, <URL:http://mydocs.epri.com/docs/public/000000000001000617.pdf> Fig. 3-19 and 3-20, pp. 3-36 and 3-37.

Bulk-Online—Salt Handling System (A forum for bulk handling of solids) [online] Feb. 6, 2007[retrieved Feb. 16, 2009] Retrieved from the internet <URL:http://www.bulk-online.com/Forum/showthread.php?threadid=9307>.

*Primary Examiner* — Faye Francis
(74) *Attorney, Agent, or Firm* — Sand & Sebolt

(57) ABSTRACT

A machine for quenching, crushing and feeding material that includes a continuous loop drag chain conveyor. A first portion of the conveyor travels through a quenching tank and a second portion travels beneath the tank's bottom wall. Large blocks of hot material are dropped onto the conveyor inside the tank. A rotary crusher is positioned to crush the cooled blocks into sized pieces as they exit the tank. The sized pieces drop through an opening in the conveyor's frame and onto the second portion of the conveyor. The pieces dewater on the second portion of the conveyor and drop through a discharge opening and into a removal device for transfer to a remote location for further processing.

23 Claims, 3 Drawing Sheets

METHOD OF USING A MATERIALS CRUSHER AND BOTTOM DUMP FEEDER

CROSS-REFERENCE TO RELATED APPLICATIONS

This application is a divisional application of U.S. patent application Ser. No. 12/351,214, filed Jan. 9, 2009, which application claims the benefit of U.S. Provisional Patent Application Ser. No. 61/010,607, filed Jan. 10, 2008; the disclosures of which are incorporated herein by reference.

BACKGROUND OF THE INVENTION

1. Technical Field

This invention generally relates to the processing and production of materials. More particularly, the invention relates to the processing of materials where a larger block of material must be broken down into sized pieces. Specifically, this invention relates to machinery that is used to quench and break down a large block of hot material into sized pieces and for distributing those sized materials and to a method of using the same.

2. Background Information

There are numerous industries that require larger pieces of material be processed to create smaller or sized pieces. For example, in the power generation and iron processing industries, it is desirable to use coke as a fuel. One type of coke is called petroleum coke or pet coke and is produced as a byproduct of crude oil refining. Pet coke is produced by placing the residual fuel oil from the crude oil refining process into a drum, known as a coker, and then applying heat and pressure thereto. The heat and pressure cause the gases and liquids to separate from the residual fuel oil, thereby forming a large block of solid material or coke within the drum. The drum's bottom flange is opened and high pressure water jets are used to cut the solidified coke from the drum's interior. The solidified coke, which can still be in the range of 800 degrees Fahrenheit in temperature, is dropped into a pit, or weir, for quenching, cooling and storage. Ultimately, a front end loader or some mechanical device is used to reclaim the coke by lifting the coke out of the weir thereof onto a conveying device to transfer and transport the coke to a remote crusher that breaks the larger coke pieces into smaller sized manageable ones. All of these steps are labor intensive, hazardous and time consuming. Every year the coke production industry spends large amount of dollars to operate the equipment needed to remove coke from the cokers, dump the coke into weirs for quenching and cooling, removing it therefrom and delivering the same to crushers and screening stations to break the large block of coke into smaller sized pieces.

There are numerous other applications and industries in which it is desirable to break down a large block of hot material into sized pieces.

There is therefore a need in the art for an improved device for quenching, crushing and distributing sized material.

SUMMARY OF THE INVENTION

The device of the present invention is a machine for crushing large blocks of material and feeding the sized pieces to a remote location. A machine for quenching, crushing and feeding material that includes a continuous loop drag chain conveyor and a quenching tank. A first portion of the conveyor travels through the tank and a second portion travels beneath the tank's bottom wall. Large blocks of hot material are dropped onto the conveyor inside the tank. A rotary crusher is positioned to crush the cooled blocks into sized pieces as they exit the tank. The sized pieces drop through an opening in the conveyor's frame and onto the second portion of the conveyor. The pieces dewater on the second portion of the conveyor and drop through a discharge opening and into a removal device for transfer to a remote location for further processing.

BRIEF DESCRIPTION OF THE DRAWINGS

The preferred embodiments of the invention, illustrative of the best mode in which applicant has contemplated applying the principles, are set forth in the following description and are shown in the drawings and are particularly and distinctly pointed out and set forth in the appended claims.

DETAILED DESCRIPTION OF THE INVENTION

Figure 1:
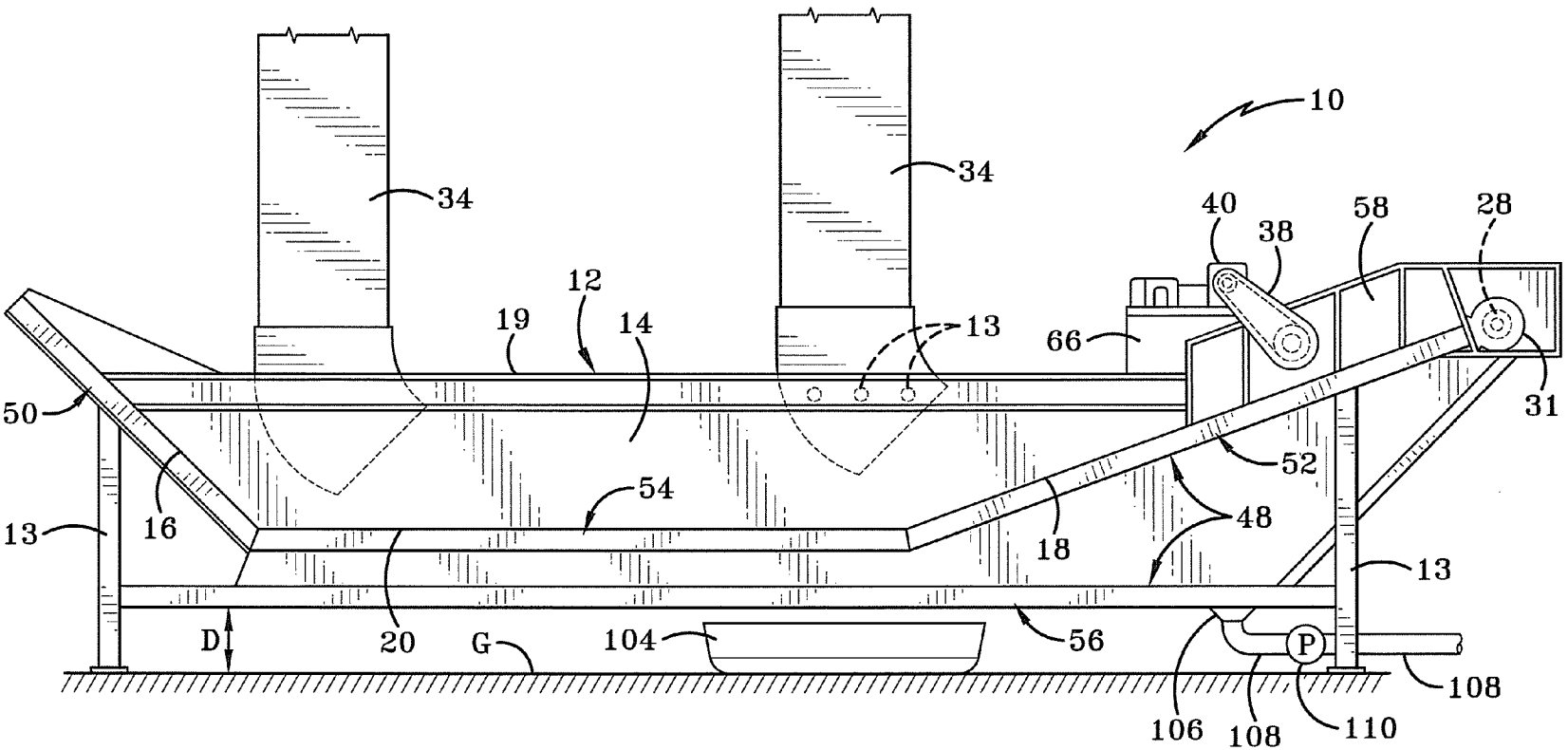
FIG. 1 is a side view of a crusher and dump feeder in accordance with the present invention.
Figure 2:
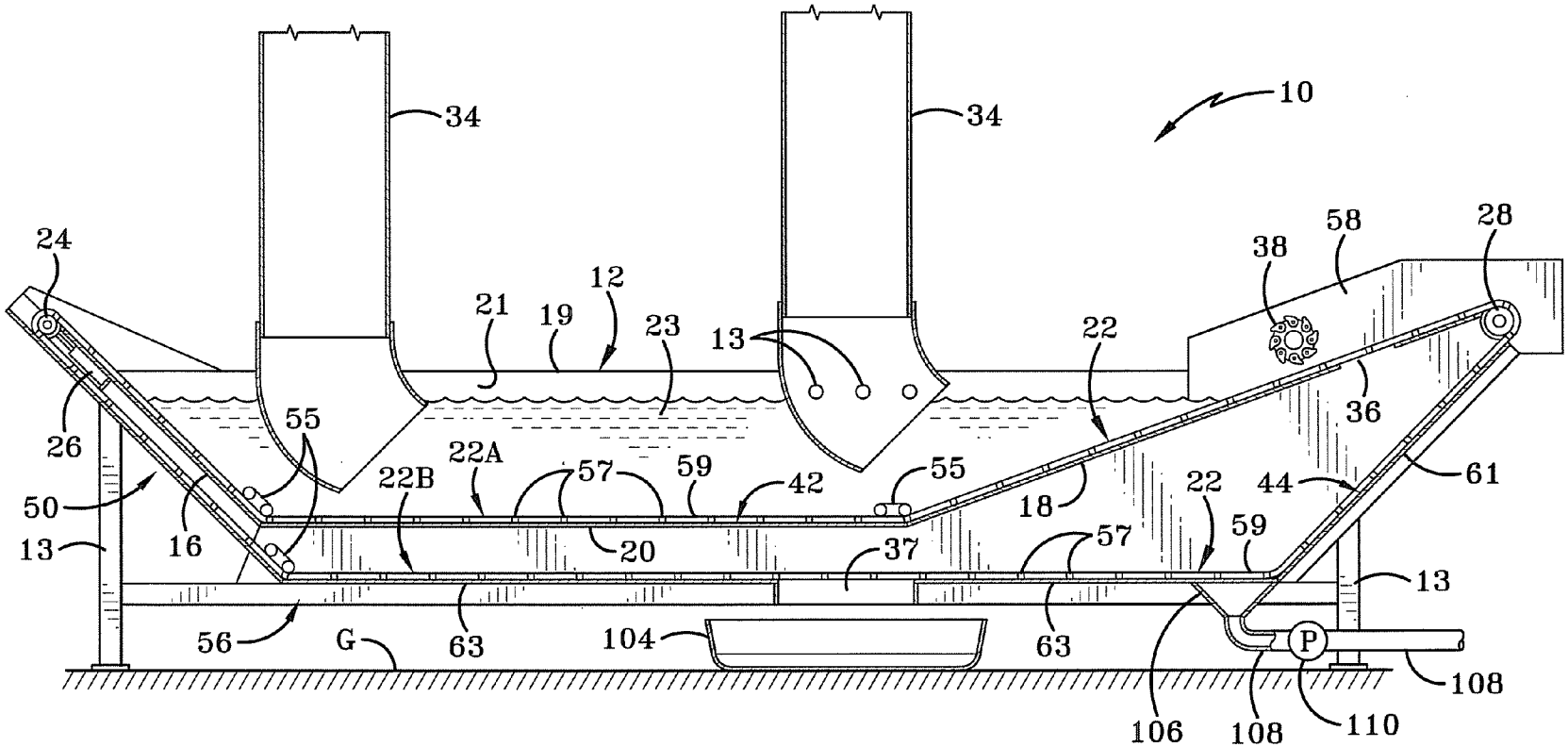
FIG. 2 is a cross-sectional side view of the crusher of FIG. 1.
Figure 3:
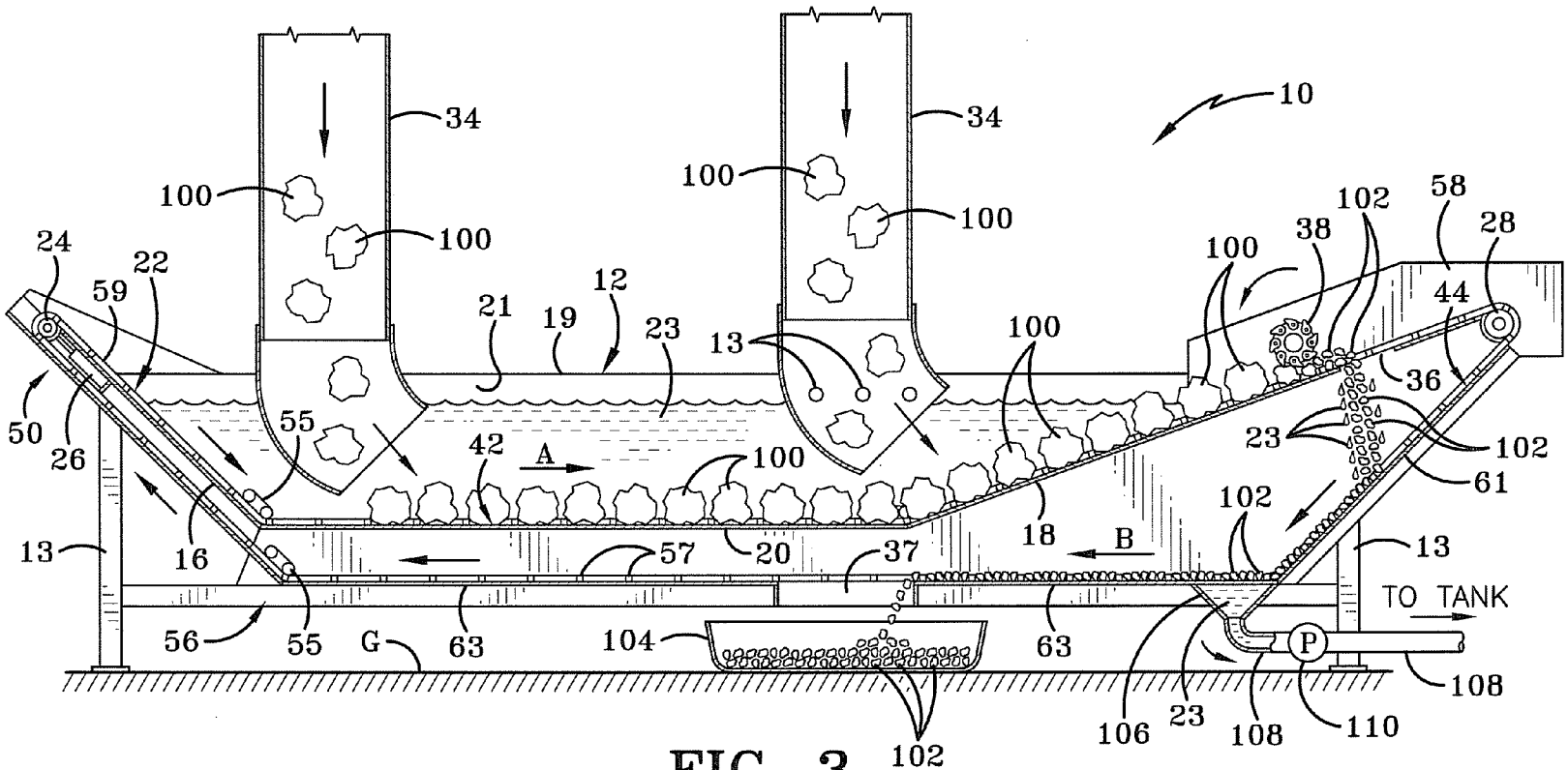
FIG. 3 is a cross-sectional side view of the crusher in operation.

Referring to FIGS. 1-3 there is shown a crusher and feeder in accordance with the present invention and generally indicated at 10. (Crusher and feeder 10 will be hereinafter referred to simply as crusher 10.) Crusher 10 is described herein as being used in the production of petroleum or PET coke. It will be understood, however, that crusher 10 is suitable for use in a wide variety of other applications that require large blocks of material to be crushed or broken down into smaller pieces of a desired size, and the description and claims should not be narrowly construed as only being applicable to the production of PET coke.

In accordance with a first specific feature of the present invention, crusher 10 includes an aboveground or above-grade quench tank 12 as opposed to an in-ground weir. Tank 12 includes side walls 14, a back end wall 16, a front end wall 18, and a bottom wall 20. Back end wall 16 and front end wall 18 are illustrated herein as being inclined at an angle other than 90 degrees relative to bottom wall 20 but it will be understood that tank 12 may be rectangular in shape with the back and front end walls 16, 18 being disposed at right angles to bottom wall 20. It will further be understood that tank 12 may be of any desired configuration that is suitable for any particular production process. Tank 12 preferably is designed so that the bottom wall 20 thereof is spaced a distance above the ground "G". This is desirable in that the sized materials produced by crusher 10 preferably exit the crusher 10 in a location beneath bottom wall 20, as will be hereinafter described. Consequently, tank 12 may be provided with a plurality of braces or supports 13 that hold tank 12 off the ground "G". Alternatively, tank 12 may be provided with a plurality of wheels or rollers (not shown) that space bottom wall 20 away from the ground and also provide mobility to tank 12.

Tank 12 preferably is open-topped and terminating in an uppermost edge 19. Walls 14-20 define a chamber 21 that is designed to hold a quantity of liquid 23 therein for quenching hot materials, such as coke that is removed from a coker (not shown). Tank 12 preferably is not filled with liquid 23 up to its uppermost edge 19 and this reduces the tendency of liquid 23 to splash out of tank 12 or spill over the uppermost edge 19 when large blocks of heated coke 100 (FIG. 3) are dropped into tank 12. The liquid 23, which typically is water, the large blocks of coke 100 and the smaller pieces of coke that break off therefrom, form a colloidal liquid dispersion that is retained within chamber 21 of tank 12.

In accordance with a specific feature of the present invention, crusher 10 includes a continuous loop drag chain conveyor 22. Conveyor 22 is mounted on a support frame 48 that retains and guides an upper section 22A thereof through chamber 21 of tank 12, and retains and guides a lower section 22B thereof beneath the bottom wall 20 of tank 12. Support frame 48 includes a first inclined section 50, a second inclined section 52 and a generally horizontal section 54 thereinbetween. First and second inclined sections 50, 52 preferably are plates that are welded onto one or more of the walls of tank 12. These plates may include a specially configured groove (not shown) that is complementary sized to the conveyor 22 that is to be received therein. Horizontal section 54 may constitute a portion of the bottom wall 20 of tank 12 or may be a separate plate that is attached thereto. The upper section 22A of conveyor 22 is placed on sections 50, 52, and 54. Support frame 48 further includes a second generally horizontal section 56 that is disposed a spaced distance beneath bottom wall 20 and is spaced a distance "D" above ground "G". Lower section 22B of conveyor 22 is disposed on section 56. Support frame 48 preferably further includes shielding regions 58 which are provided to prevent crushed materials from harming persons in the vicinity of the crusher 10. Frame 48 further includes an inclined support member 61 that extends between I section 56 and a region proximate gear 28. Support member 61 provides a base along which a lower section 22B of conveyor 22 travels after it passes around gear 28.

Deflectors 55 are provided to aid in transitioning conveyor 22 from one member of support frame 48 to another. It will be understood that the members 50-61 of support frame 48 may comprise regions of walls 14-20 of tank 12 or may be separate plates that are welded to tank 12, or may be individual members that are assembled together and introduced into tank 12.

A sprocket 24 is provided proximate the free end of section 50 of support frame 48 and a gear 28 is mounted proximate the free end of section 52 of support frame 48. A motor 31 is mounted on section 52 adjacent gear 28 and is provided to drive conveyor 22. As shown in FIG. 3, conveyor 22 preferably is driven in a direction "A" through tank 12 and in a direction "B" beneath bottom wall 20 of tank 12. A tensioning device 26 is associated with sprocket 24 and is provided to maintain the tension on conveyor 22.

The configuration of the drag chain conveyor 22 is selected in accordance with the type of materials that are to be quenched, crushed and distributed by crusher 10. It will be understood that any design of drag chain conveyor could be utilized in the present invention. By way of example only, drag chain conveyor 22 as illustrated includes a plurality of pusher bars 57 disposed orthogonally between a pair of spaced apart chains 59. Pusher bars 57 are secured at spaced intervals from each other along chains 59 and are constructed to be strong enough to support and push the large blocks of material 100 through tank 12.

One or more feed chutes 34 are disposed so as to extend downwardly toward and into tank 12. Feed chutes 34 do not necessarily form part of the crusher 10, itself but may instead form part of the coker or may be portable units. Feed chutes 34 are disposed a spaced distance apart from each other and are provided at intervals along the length of tank 12. Chutes 34 are designed to be able to be vertically raised or lowered relative to bottom wall 20 and are moved accordingly depending on the level of the colloidal liquid dispersion in tank 12. The adjustability in the vertical positioning of chutes 34 aids in reduce the tendency of liquid to splash outwardly from tank 12.

In accordance with another specific feature of the present invention, a rotary crusher 38 is mounted on one of the tank 12 and the support frame 48. In the preferred embodiment illustrated herein, rotary crusher 38 is mounted on a support 66 that extends from one of the side walls 14 of tank 12 and extends over the conveyor 22 toward the uppermost end of the more gently inclined portion 52 of support frame 48. Preferably, section 52 of support frame 48 is reinforced in the region proximate rotary crusher 38. Rotary crusher 38 is rotatably driven by a motor 40 that is also mounted on support 66. Rotary crusher 38 is positioned so as to be able to engage larger blocks of material 100 that are carried on upper section 22A of conveyor 22 as they travel upwardly out of tank 12. The more gently inclined section 52 aids in feeding the larger blocks of material 100 to the rotary crusher 38 and reduces the tendency of those larger blocks to roll back down the incline and onto the horizontal portion of the conveyor supported on section 54 of support frame 48. The gentler slope of section 52 also provides more surface area for the rotary crusher 38 to engage the material blocks 100 and provides a more solid base onto which those materials may be crushed. Preferably, the position of rotary crusher 38 relative to conveyor 22 is vertically adjustable so that the operator can change the size of the crushed materials produced thereby. If the space between rotary crusher 38 and conveyor 22 is relatively large, then the sized materials 102 produced by rotary crusher 38 will be relative large. If the space between rotary crusher 38 and conveyor 22 is relatively small, then the sized materials 102 produced thereby will be relatively small.

In accordance with yet another specific feature of the present invention, a first opening 36 is provided in section 52 of support frame 48. The first opening 36 (FIG. 2) is provided intermediate rotary crusher 38 and gear 28. This first opening 36 is positioned so that sized materials produced by rotary crusher 38 will drop through first opening 36 and onto a portion of conveyor 22 that has passed around gear 28 and is heading downwardly toward section 56 of support frame 48. A discharge opening 37 (FIG. 2) is provided in section 56 of support frame 48 and in a location that is disposed beneath bottom wall 20 of tank 12.

Crusher 10 is used in the following manner. Large blocks of hot material 100 are stripped from one or more cokers (not shown) using water jets and these blocks fall through chutes 34 into the liquid 23 in quench tank 12. The large blocks of material 100 may remain substantially intact, but might also fracture into several smaller blocks of material as they hit the liquid 23 or conveyor 22. Tank 12 may also be provided with a plurality of breaker bars 13 that extend between side walls 14 and are spaced slightly inwardly from uppermost edge 19. The breaker bars 13 will aid in breaking the large blocks of material 100 into smaller blocks. Neither the large blocks 100 nor the smaller blocks will typically be of the desired end size. The position of chutes 34 relative to bottom wall 20 may be adjusted vertically upwardly or downwardly in order to minimize the possibility of splashing as the large blocks 100 drop into the liquid 23. The large blocks of material 100 sink downwardly through liquid 23 and settle onto upper section 22A of conveyor 22 and portions of upper surface 42 (FIG. 2) of bottom wall 20. Conveyor 22 is driven by the motor 31 associated with gear 28 and moves in the direction "A". As conveyor 22 moves, so do the large blocks of material 100 that have settled thereon. The blocks of material 100 are cooled as they move through liquid 23. Conveyor 22 is driven up section 52 of support frame 48 and toward gear 28. The rotary crusher 38 is activated. As the large blocks of material 100 encounter the rotating head of the rotary crusher 38, they are broken down into smaller pieces. Eventually, the smaller pieces are of a size that permits them to pass between rotary crusher 38 and conveyor 22 as sized material 102 (FIG. 3) Sized material 102 moves with conveyor 22 until the first opening 36 is reached. The sized material 102 drops through first opening 36 and onto lower section 22B of conveyor 22 and portions of upper surface 44 (FIG. 2) of support member 61 that are disposed beneath opening 36. The sized pieces 102 are moved along lower section 22B and portions of the upper surfaces 61 and 63 of conveyor 22 by pusher bars 57. As the sized materials 102 travel along lower section 22B of conveyor 22, liquid retained on sized pieces 102 drops through a dewatering screen (not shown) disposed on section 56 beneath conveyor 22. The removed liquid is collected via a funnel 106 and is returned to tank through tubing 108 with the aid of a pump 110. Although not illustrated herein, the sized materials 102 may additionally be sprayed with clean water or may be further processed by spraying the same with one or more chemicals.

When the sized pieces 102 reach discharge opening 37, they drop therethrough and are captured in a removal vehicle for further handling, sorting, or processing at a remote location. A suitable removal vehicle would include a bin 104 or hopper, as is illustrated in the attached figures, or an additional conveyor belt (not shown).

Crusher 10 is useful for quenching large hot blocks of material 100, for crushing those large blocks 100 into sized materials 102 and then delivering the sized materials 102 to a discharge opening 37 for removal in a removal vehicle 104 to a remote location for further processing. This is all accomplished in a single unit. Crusher 10 therefore negates the labor and time required to use a loader to remove large blocks of quenched material from a below-grade weir, to then transfer those large blocks onto a truck or conveyor in order to transport them to a remote crusher for sizing. Crusher 10 may be provided with means to make it a portable unit, such as wheels or tracks, for example, so that it can be brought into the vicinity of the cokers.

It will be understood that crusher 10 may. Alternatively be provided without the first opening 36 and the discharge opening 37 in support frame 48. In this instance, sized materials 102 produced by the rotary crusher 38 will travel along conveyor 22 and as the conveyor changes direction around gear 28, those sized materials will drop under the influence of gravity into a removal device such as a bin or a second conveyor that is placed beneath the gear 28. If support frame 48 is not provided with openings 36 and 37, then there is little to no need to have bottom wall 20 spaced a distance above the surface of the ground "G" and support frame section 56 may then be utilized as a base for tank 12 and be placed directly onto the ground surface "G".

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention are an example and the invention is not limited to the exact details shown or described.

The invention claimed is:

1. A method of processing material comprising the steps of:
placing a quantity of the material into a coker;
applying heat to the material in the coker;
removing heated large blocks of material from the coker;
activating a continuous loop drag chain conveyor so that a first portion thereof moves through water contained in a quench tank;
depositing the heated large blocks of material onto the first portion of the conveyor;
advancing the conveyor through the water in the quench tank;
cooling the heated large blocks of material;
activating a rotary crusher disposed adjacent a portion of the conveyor; and
rotating the rotary crusher so as to break up the large blocks of material carried on the conveyor into smaller sized pieces of material.

2. The method as defined in claim 1, wherein the step of depositing the heated large blocks of material onto the first portion of the conveyor further includes the step of:
dropping the heated large blocks of material onto breaker bars positioned between the chute and the water.

3. The method as defined in claim 1, wherein the step of advancing the conveyor further comprises the steps of:
advancing the first portion of the conveyor along a horizontal support to carry the large blocks through the water in the quench tank, and
advancing the first portion of the conveyor up an inclined support from a lower region of the tank to an upper region of the tank to carry the large blocks out of the water.

4. The method as defined in claim 3, wherein the step of activating the rotary crusher includes the step of:
positioning the rotary crusher adjacent the conveyor and where it will engage the large blocks of material after they have exited the water.

5. The method as defined in claim 1, wherein the step of heating the material in the coker includes heating the material to a temperature of about 800° F.

6. The method as defined in claim 1, wherein the step of activating the rotary crusher further includes the step of:
positioning the rotary crusher so as to engage the large blocks of material before they exit from a second end of the quench tank.

7. A method of reducing the size of heated large blocks of material comprising:
activating a continuous loop drag chain conveyor so that a first portion thereof moves through water contained in a quench tank;
depositing the hot large blocks of material onto the first portion of the conveyor, including the step of
stripping the large blocks of material from a coker;
advancing the conveyor through the quench tank;
activating a rotary crusher disposed adjacent a portion of the conveyor; and
rotating the rotary crusher so as to break up the large blocks of material carried on the conveyor into smaller sized pieces of material.

8. The method as defined in claim 7, further comprising the step of:
blasting coked material disposed within the coker with jets of water to strip the large blocks of material therefrom.

9. The method as defined in claim 7, further comprising the step of:
positioning a chute adjacent the coker to direct the hot large blocks of material stripped therefrom into the quench tank.

10. The method as defined in claim 9, further comprising the step of:

adjusting the chute vertically relative to a top surface of the water contained within the quench tank to minimize splashing.

11. The method as defined in claim 9, further comprising the step of:

adjusting the chute horizontally relative to a side of the quench tank to correctly position the chute to direct the hot large blocks of material onto the first portion of the conveyor.

12. The method as defined in claim 7, wherein the step of activating the rotary crusher further includes the step of:

positioning the rotary crusher so as to engage the large blocks of material before they exit from a second end of the quench tank.

13. A method of reducing the size of heated large blocks of material comprising:

activating a continuous loop drag chain conveyor so that a first portion thereof moves through water contained in a quench tank;

depositing the hot large blocks of material onto the first portion of the conveyor;

advancing the conveyor through the quench tank; and wherein the step of advancing the conveyor further comprises the steps of:

advancing the first portion of the conveyor along a horizontal support to carry the large blocks through the water in the quench tank, and advancing the first portion of the conveyor up an inclined support from a lower region of the tank to an upper region of the tank to carry the large blocks out of the water;

activating a rotary crusher disposed adjacent a portion of the conveyor; and wherein the step of activating the rotary crusher further includes the step of:

positioning the rotary crusher adjacent the conveyor and where it will engage the large blocks of material after they have exited the water;

rotating the rotary crusher so as to break up the large blocks of material carried on the conveyor into smaller sized pieces of material; and advancing the conveyor over an opening in the inclined support positioned after the rotary crusher.

14. The method as defined in claim 13, further comprising the step of:

collecting the smaller sized pieces of material dropped through the opening.

15. The method as defined in claim 14, wherein the step of collecting the smaller sized pieces of material includes:

positioning a collection vehicle vertically beneath the opening.

16. The method as defined in claim 14, further comprising the step of:

spraying the sized pieces of material with a one of clean water and a liquid chemical after the smaller sized pieces of material drop through the opening.

17. The method as defined in claim 16, further comprising the step of:

dewatering the smaller sized pieces of material as they travel along the second portion of the conveyor.

18. The method as defined in claim 17, further comprising the steps of:

capturing the water removed from the sized pieces of material during dewatering; and recycling the captured water back into the quench tank.

19. The method as defined in claim 14, wherein the step of collecting the smaller sized pieces of material includes:

advancing a second portion of the conveyor beneath the opening; and dropping the smaller sized pieces of material onto the second portion of the conveyor.

20. The method as defined in claim 19, further comprising the step of:

advancing the second portion of the conveyor beneath a bottom wall of the quench tank.

21. The method as defined in claim 20, wherein the step of advancing the second portion of the conveyor beneath the bottom wall includes:

moving the second portion of the conveyor in a direction opposite to the first portion of the conveyor.

22. The method as defined in claim 21, further comprising the step of:

advancing the second portion of the conveyor over a discharge opening in a support frame disposed beneath the bottom wall of the quench tank; and dropping the sized pieces of material through the discharge opening.

23. The method as defined in claim 22, further including the steps of:

positioning a removal device beneath the discharge opening; and transferring the removal device from beneath the discharge opening to a remote location.

* * * * *